US010801274B2

(12) United States Patent
Mau et al.

(10) Patent No.: US 10,801,274 B2
(45) Date of Patent: Oct. 13, 2020

(54) EXTENDABLE ELEMENT SYSTEMS FOR DOWNHOLE TOOLS

(71) Applicants: Fabian Mau, Vechelde (DE); Heiko Eggers, Bad Fallingbostel (DE); Volker Peters, Wienhausen (DE); Detlev Benedict, Celle (DE)

(72) Inventors: Fabian Mau, Vechelde (DE); Heiko Eggers, Bad Fallingbostel (DE); Volker Peters, Wienhausen (DE); Detlev Benedict, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/270,032

(22) Filed: Sep. 20, 2016

(65) Prior Publication Data

US 2018/0080297 A1 Mar. 22, 2018

(51) Int. Cl.
*E21B 17/10* (2006.01)
*E21B 47/12* (2012.01)
*E21B 4/18* (2006.01)

(52) U.S. Cl.
CPC ..... *E21B 17/1014* (2013.01); *E21B 4/18* (2013.01); *E21B 47/12* (2013.01)

(58) Field of Classification Search
CPC ..... E21B 23/00; E21B 23/01; E21B 7/04
See application file for complete search history.

(56) References Cited

U.S. PATENT DOCUMENTS 5,636,690 A 6/1997 Garay
5,699,866 A * 12/1997 Cousins ..... E21B 7/061 175/78
6,073,693 A 6/2000 Aldridge
6,722,441 B2 4/2004 Lauritzen et al.
7,900,708 B2 3/2011 Obrejanu
8,931,569 B2 1/2015 Fagley et al.
(Continued)

FOREIGN PATENT DOCUMENTS

GB 2309306 A 7/1997

OTHER PUBLICATIONS

"Excalibre Downhole Torque Anchor (EDT)", Excalibre Downhole Tools Ltd., [Retrieved via internet on Jan. 17, 2018: http://excalibretools.com/torque-anchors/excalibre-downhole-torque-anchor/]; 1 page.
(Continued)

*Primary Examiner* — David J Bagnell
*Assistant Examiner* — Dany E Akakpo
(74) *Attorney, Agent, or Firm* — Cantor Colburn LLP

(57) ABSTRACT

Extendable elements of downhole tools are provided having an extension direction component perpendicular to a tool axis, wherein a force is applied to the extendable element when in operation. The extendable elements comprise a first cross-section that includes the extension direction component, a first surface configured to receive a first force component of the force, the first force component substantially perpendicular to the first surface and a second surface configured to transfer at least a portion of the first force component of the force to a body of the downhole tool. The second surface and the extension direction component perpendicular to the tool axis draw a first angle that is between 0° and 90°.

23 Claims, 8 Drawing Sheets

(56) References Cited

U.S. PATENT DOCUMENTS

| | | | | |
|---|---|---|---|---|
| 8,939,220 | B2 | 1/2015 | Harris | |
| 9,004,195 | B2 | 4/2015 | Regener et al. | |
| 9,341,027 | B2 | 5/2016 | Radford et al. | |
| 2003/0121655 | A1 | 7/2003 | Lauritzen et al. | |
| 2003/0188861 | A1* | 10/2003 | Doyle | E21B 23/01 166/206 |
| 2006/0042835 | A1* | 3/2006 | Guerrero | E21B 7/06 175/61 |
| 2006/0065391 | A1 | 3/2006 | Carr | |
| 2006/0243487 | A1 | 11/2006 | Turner et al. | |
| 2008/0099205 | A1 | 5/2008 | Fay et al. | |
| 2009/0071659 | A1* | 3/2009 | Spencer | E21B 23/01 166/382 |
| 2010/0101779 | A1* | 4/2010 | Obrejanu | E21B 23/01 166/216 |
| 2012/0168160 | A1 | 7/2012 | Nutley et al. | |
| 2012/0298378 | A1 | 11/2012 | McCauley et al. | |
| 2014/0166313 | A1 | 6/2014 | Moore et al. | |
| 2014/0203516 | A1 | 7/2014 | Kocurek et al. | |
| 2015/0047829 | A1 | 2/2015 | Millet et al. | |
| 2015/0060143 | A1 | 3/2015 | Radford et al. | |
| 2015/0144327 | A1 | 5/2015 | Millet et al. | |
| 2015/0259997 | A1 | 9/2015 | Millet et al. | |

OTHER PUBLICATIONS

International Search Report, International Application No. PCT/US2017/052366, dated Jan. 4, 2018, Koren Intellectual Property Office; International Search Report 3 pages.

International Written Opinion, International Application No. PCT/US2017/052366, dated Jan. 4, 2018, Koren Intellectual Property Office; Written Opinion 10 pages.

European Search Report for European Application No. 17853764.3, dated Apr. 30, 2020, 8 pages.

* cited by examiner

EXTENDABLE ELEMENT SYSTEMS FOR DOWNHOLE TOOLS

BACKGROUND

1. Field of the Invention

The present invention generally relates to extendable elements for downhole tools and/or downhole components such as bottomhole assemblies, anchor tools, anchors, liner running tools, hangers, extendable stabilizers, reamers, steering tools, measuring tools (e.g., caliper), expander tools (e.g., tools for expanding liner tubes), centralizers or other tools configured to position a downhole component within a borehole by means of extendable elements.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In more detail, wellbores or boreholes for producing hydrocarbons (such as oil and gas) are drilled using a drill string that includes a tubing made up of, for example, jointed tubulars or continuous coiled tubing that has a drilling assembly, also referred to as the bottomhole assembly (BHA), attached to its bottom end. The BHA typically includes a number of sensors, formation evaluation tools, and directional drilling tools. A drill bit attached to the BHA is rotated with a drilling motor in the BHA and/or by rotating the drill string to drill the wellbore. While drilling, the sensors can determine several attributes about the motion and orientation of the BHA that can used, for example, to determine how the drill string will progress. Further, such information can be used to detect or prevent operation of the drill string in conditions that are less than favorable.

A well, e.g., for production, is generally completed by placing a casing (also referred to herein as a "liner" or "tubular") in the wellbore. The spacing between the liner and the wellbore inside, referred to as the "annulus," is then filled with cement. The liner and the cement may be perforated to allow the hydrocarbons to flow from the reservoirs to the surface via a production string installed inside the liner. Some wells are drilled with drill strings that include an outer string that is made with the liner and an inner string that includes a drill bit (called a "pilot bit"), a bottomhole assembly, and a steering device. The inner string is placed inside the outer string and securely attached therein at a suitable location. The pilot bit, bottomhole assembly, and steering device extend past the liner to drill a deviated well. The pilot bit drills a pilot hole that is enlarged by a reamer attached to the bottom end of the liner. Reamers are well established tools in the industry as standalone tools or integrated within other tools such as, for instance, liner drilling tools. A reamer may have fixed blades or extendable elements such as blades configured to be extended and/or retracted in response to a signal or a particular condition. The liner is then anchored to the wellbore. The inner string is pulled out of the wellbore and the annulus between the wellbore and the liner is then cemented.

The disclosure herein provides improvements to drill strings and methods for using the same to drill a wellbore and cement the wellbore during a single trip.

SUMMARY

Disclosed herein are extendable elements of downhole tools having an extension direction component perpendicular to a tool axis, wherein a force is applied to the extendable element when in operation. The extendable elements comprise a first cross-section that includes the extension direction component, a first surface configured to receive a first force component of the force, the first force component substantially perpendicular to the first surface and a second surface configured to transfer at least a portion of the first force component of the force to a body of the downhole tool. The second surface and the extension direction component perpendicular to the tool axis draw a first angle that is between 0° and 90°.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are apparatus and systems for extendable elements in downhole tools. Embodiments provided herein enable improved stress profiles and/or improved component life by optimizing stress and force distribution at extendable elements in downhole components. Further, embodiments provided herein provide stop blocks for extendable elements that enable improved distribution and transfer of forces and weight within and through a downhole component.

Figure 1:
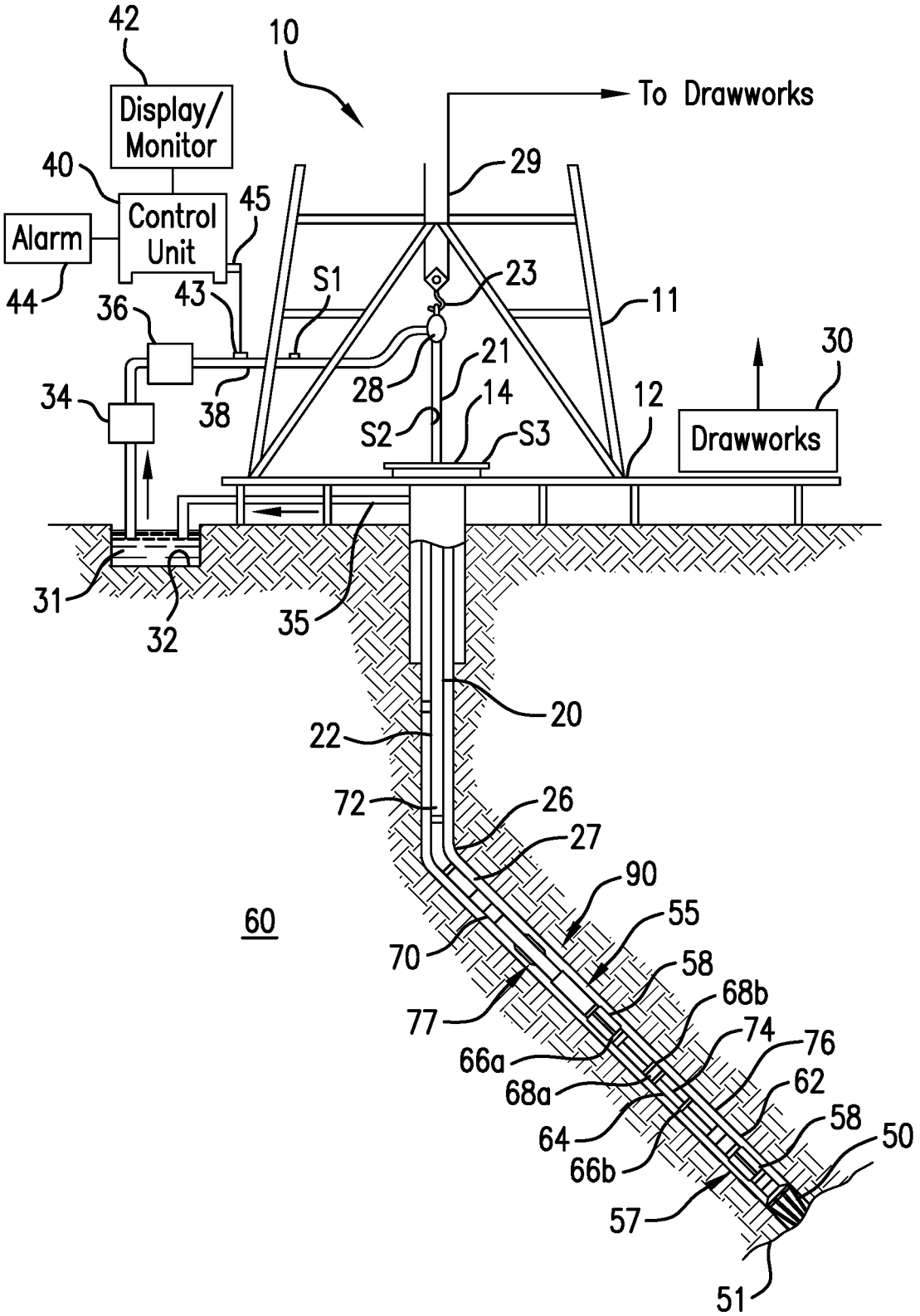
FIG. 1 is an exemplary drilling system.

FIG. 1 shows a schematic diagram of a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is energized by rotation, electrical pulses, fluid flow, or any other energizing mechanism to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. One or more stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor(s) 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64 may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein pipe sections include a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, many parts that are discussed above are optional for various embodiments of the present disclosure. For instance LWD tools, downhole or surface sensors, displays, alarms, and/or mud motors, may or may not be parts of drilling systems that employ embodiments of the present disclosure. The various downhole components may hate a different sequence or order of connection. In some embodiments, the motor 55 may be powered by electric energy instead of or in additional to flow energy. Control units, displays, and/or alarms may be on the rig site or at an offsite location. In addition, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

With a new developed system the cementing job shall be implemented in this procedure as well, reducing the process to one single run. For that, a special running tool is needed that is able to be connected in several positions. High loads due to the additional weight of the liner and also the generated torque by the friction between liner and the previously run casing or open hole result in high stressed drill string geometry. As provided herein, the design of running tools that was derived from reamers has been optimized using Finite Element Analysis.

For example, as provided herein, a rectangular track profile has been changed to a three-center curve profile that leads to a smoother distribution of forces. In some embodiments of the present disclosure, the transmission of the liner weight into the running tool body is achieved by using a screw-on nut with thread connection. Further, in accordance with some embodiments, a torsional load profile has been optimized to enable relatively high torque ratings. Such optimization can also provide benefits to existing reamer designs because the overall stress amplitude will be reduced significantly, thus improving the reliability and life-time of the drill string components. An example of an extendable reamer is shown and described in U.S. Pat. No. 9,341,027, entitled "Expandable reamer assemblies, bottom-hole assemblies, and related methods," filed on Mar. 4, 2013, and incorporated herein in its entirety. Such modified track profiles can be used in various downhole tools and/or downhole components such as bottomhole assemblies, anchor tools, anchors, liner running tools, hangers, extendable stabilizers, reamers, steering tools, measuring tools (e.g., calipers), expander tools (e.g., tools for expanding liner tubes), centralizer or other tools configured to position a downhole component within a borehole by means of extendable elements, etc., and those of skill in the art will appreciate that embodiments of the present disclosure are not limited to the above.

Figure 2A:
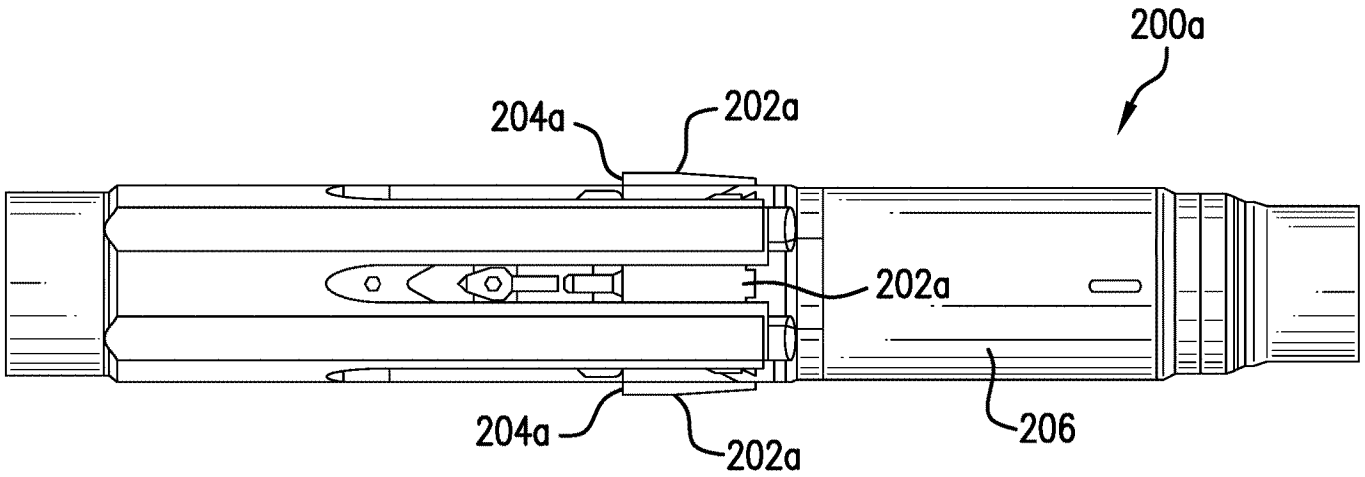
FIG. 2A is a schematic illustration of a tool body having an extendable element system in accordance with an embodiment of the present disclosure.
Figure 2B:
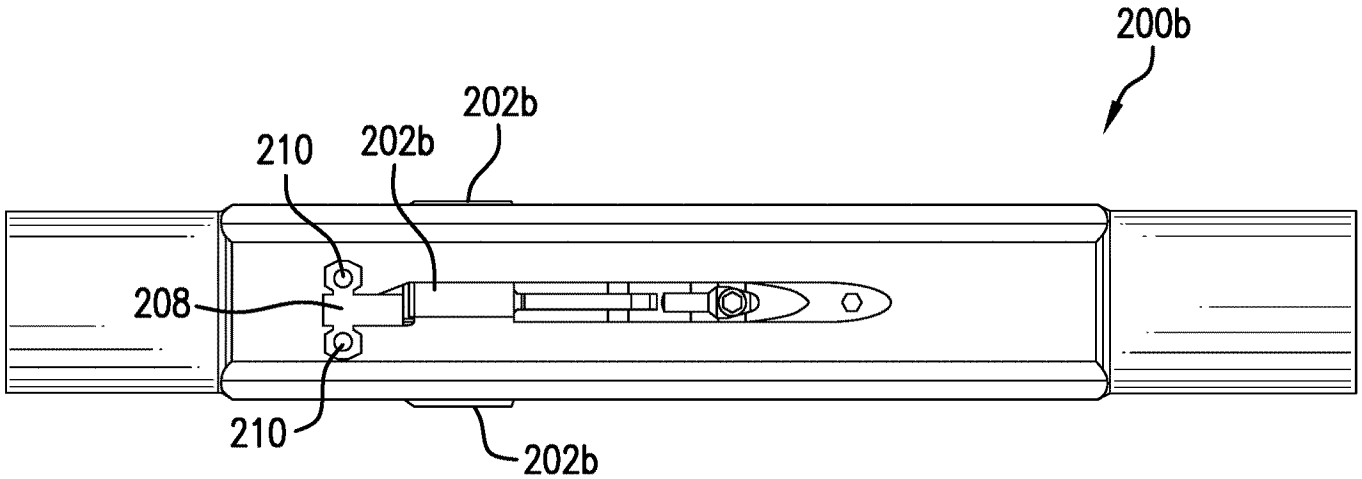
FIG. 2B is a schematic illustration of a tool body having an extendable element system in accordance with another embodiment of the present disclosure.

For example, turning to FIGS. 2A-2B, example configurations of portions of tool bodies 200*a*, 200*b* in accordance with embodiments of the present disclosure are schematically shown. Each of the tool bodies 200*a*, 200*b* are configured with one or more extendable elements that may be configured in accordance with embodiments of the present disclosure. Those of skill in the art will appreciate that the tool bodies 200*a*, 200*b* can be portions of a downhole system such as shown in FIG. 1 and/or variations thereon. The tool bodies 200*a*, 200*b* can be any type of downhole tool as known in the art, and the particular schematic illustration is not intended to be limiting.

For transmitting weight a number of weight extendable elements 202*a* can be configured about a circumference of the tool body 200*a* (e.g., a weight module body of a downhole tool), as shown in FIG. 2A. As shown, a number of weight extendable elements 202*a* are equally distributed over a circumference of the tool body 200*a*. Contact areas 204*a* of the weight extendable elements 202*a* are designed in such a way that a yield-strength of the material of the extendable element is not exceeded for a full-weight capacity. The contact area of the extendable elements is not limited to the indicated surface and other surfaces or portions of the extendable elements may contact or otherwise be configured to enable the transfer of weight, torque, or other forces. Further, in some embodiments, the extendable elements described herein may be designed or otherwise configured in a way that allows for a limited amount of plastic deformation when under load, the plastic deformation considered to be acceptable to maintain the extendable element operable its intended purpose(s). The weight of the tool body

200*a* (and any connected components) is further transmitted into a stop block 206 (e.g., a sleeve, a screw-on nut, etc.) that is connected with the tool body 200*a* via a threaded connection, as known in the art.

For the transmission of torque a number of torque extendable elements 202*b* are configured on a tool body 200*b*, as shown in FIG. 2B. As shown in FIG. 2B, the number of torque extendable elements 202*b* is reduced compared to the number of weight extendable elements 202*a* shown in FIG. 2A. Alternatively, if the expected load is higher, the number of toque extendable elements 202*b* may be equal or higher compared to the number of weight extendable elements 202*a*. In the embodiment of FIG. 2B, three torque extendable elements 202*b* are equally distributed over the circumference of the tool body 200*b* (e.g., a torque module body of a downhole tool). A mechanical stop for the torque extendable elements 202*b* is accomplished by a stop block 208 that is fixed with screws or other fasteners 210 to the tool body 200*b*.

Those of skill in the art will appreciate that the tool bodies 200*a*, 200*b* can be portions of a single tool or configuration. For example, a weight-transfer tool body 200*a* and a torque-transfer tool body 200*b* can be tool bodies on a single tool and may be configured to provide advantages to a single tool configuration.

In one non-limiting embodiment, a tool incorporates both a weight-transfer tool body and a torque-transfer tool body, as shown and described with respect to FIGS. 2A-2B. In such an embodiment, the weight-transfer tool body include less or more extendable elements than the torque-transfer tool body (e.g., as shown in FIGS. 2A-2B). The different number of extendable elements in the two tool bodies (e.g., different modules) can be beneficial to prevent that the weight extendable elements are able to latch into a profile of the liner for torque transfer and the other way around. The profile for the weight transmission is simply a circumferential groove with a solid shoulder.

Each of the extendable elements 202*a*, 202*b* is installed into the respective tool body 200*a*, 200*b* in an extendable element track. The extendable element track traditionally includes a rectangular shaped slot. The extendable element track is configured to geometrically receive the respective extendable element. The track profile and extendable element profile (and the material of the extendable elements) are selected to the enable the most efficient transfer of forces and/or stresses in or on a tool body (e.g., weight, torque, etc.).

In accordance with embodiments of the present disclosure extendable elements and respective extendable element tracks are provided to improve stress amplitudes in tool bodies and/or connected parts. For example, in accordance with various embodiments of the present disclosure, by modifying the extendable element track profile the stress amplitude can be reduced significantly. In non-limiting embodiments, the traditional rectangular profile has been changed to a centric or multi-center curve profile (e.g., a three-center curve profile) or other curved geometric profile that leads to a smoother distribution of force and lower stress.

Figure 3A:
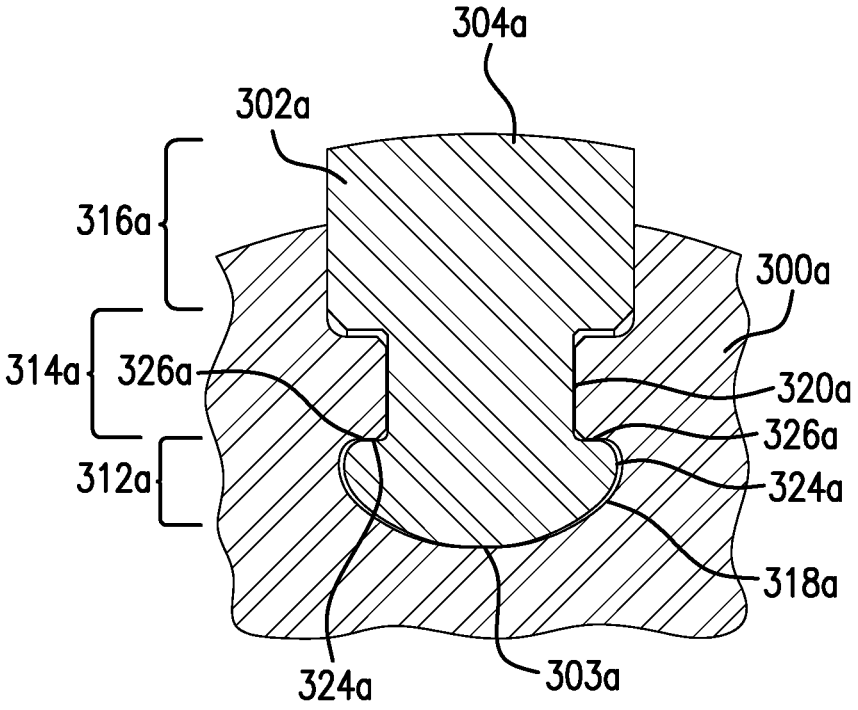
FIG. 3A is a schematic illustration of an extendable element engaged within a track of a tool body in accordance with an embodiment of the present disclosure.
Figure 3B:
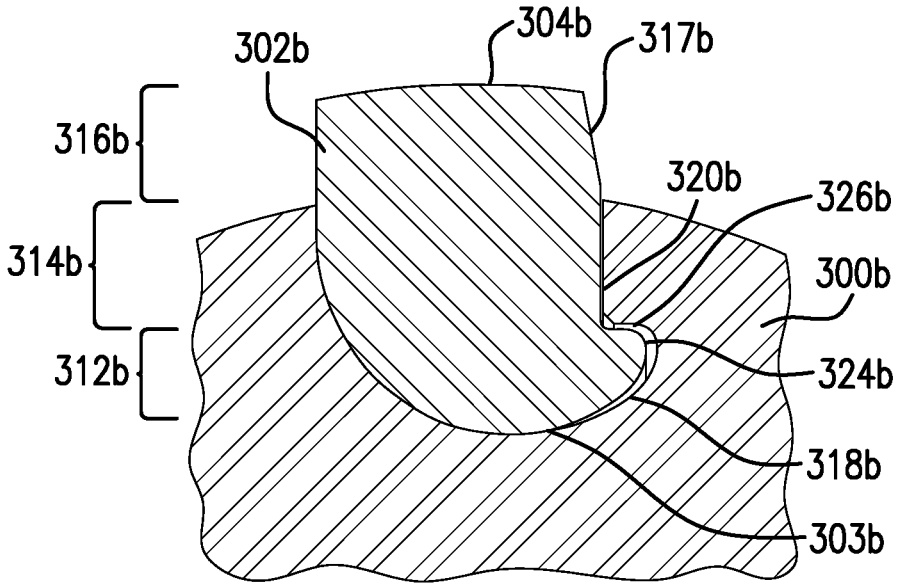
FIG. 3B is a schematic illustration of an extendable element engaged within an track of a tool body in accordance with another embodiment of the present disclosure.

Turning to FIGS. 3A-3B, example cross-sectional views of extendable elements and extendable element tracks in accordance with non-limiting, example embodiments of the present disclosure are shown. FIG. 3A illustrates schematically an extendable element and extendable element track with a curvilinear symmetric geometry. FIG. 3B illustrates schematically an extendable element and extendable element track with a curvilinear asymmetric geometry. As shown, each extendable element 302*a*, 302*b* is configured within a respective extendable element track 303*a*, 303*b* of a tool body 300*a*, 300*b*. In some non-limiting embodiments, the extendable element 302*a* of FIG. 3A is configured as a weight anchor and the extendable element 302*b* of FIG. 3B is configured as a torque anchor, and each extendable element 302*a*, 302*b* can be configured in a tool body similar to that shown in FIGS. 2A-2B. Those of skill in the art will appreciate that weight and torque anchors may be configured to transmit multiple loads (e.g., combinations of axial, radial, and/or torsional). The difference of weight and torque is that the capacity to transmit weight or torque is higher for weight or torque anchors compared to torque or weight anchors, respectively. Although in some configurations the extendable elements of the present disclosure can be anchors for tool bodies, those of skill in the art will appreciate that the extendable elements can be used for various other functions and tools or components such as, but not limited to, lining wellbores with liner running tools, stabilizing with extendable stabilizers, reaming with a reamer, steering with steering tools, load transmission with anchors, measuring tools (e.g., distance measurements with caliper tools), expanding wellbore equipment with expander tools (e.g., tools for expanding liner tubes), positioning with centralizer or other tools configured to position a downhole component within a borehole by means of extendable elements.

Each of the extendable elements 302*a*, 302*b* includes a first portion 312*a*, 312*b*, a second portion 314*a*, 314*b*, and a third portion 316*a*, 316*b*. The first portion 312*a*, 312*b* of each respective extendable element 302*a*, 302*b* can be configured to engage within a receiving portion 318*a*, 318*b* of the extendable element track. The extendable element track, for example in some embodiments, may be incorporated in the tool body or in a cartridge, a frame, or a cassette that is connected to the respective tool body 300*a*, 300*b*. The second portion 314*a*, 314*b* of the extendable elements 302*a*, 302*b* is configured to pass through an intermediate section 320*a*, 320*b* of the respective tool body 300*a*, 300*b* or a cartridge, a frame, or a cassette that is connected to the respective tool body 300*a*, 300*b*. The third portion 316*a*, 316*b* of the respective extendable element 302*a*, 302*b* is configured to extend from the tool body 300*a*, 300*b* or a cartridge, a frame, or a cassette that is connected to the respective tool body 300*a*, 300*b* and includes or defines a contact surface 304*a*, 304*b*, which in some embodiments may be any exposed surface of the extendable element 302*a*, 302*b* (e.g., the flanks of the extendable tool that are exposed above the surface of the tool body).

As shown, the first portion 312*a*, 312*b* of the extendable elements 302*a*, 302*b* includes one or more first engagement surfaces 324*a*, 324*b*. The first engagement surfaces 324*a*, 324*b* are configured to engage with respective second engagement surfaces 326*a*, 326*b* of the extendable element tracks 303*a*, 303*b*. As shown, the second engagement surfaces 326*a*, 326*b* are defined, in part, as a transition between the receiving portions 318*a*, 318*b* and the intermediate sections 320*a*, 320*b* of the extendable element tracks 303*a*, 303*b*.

Figure 4:
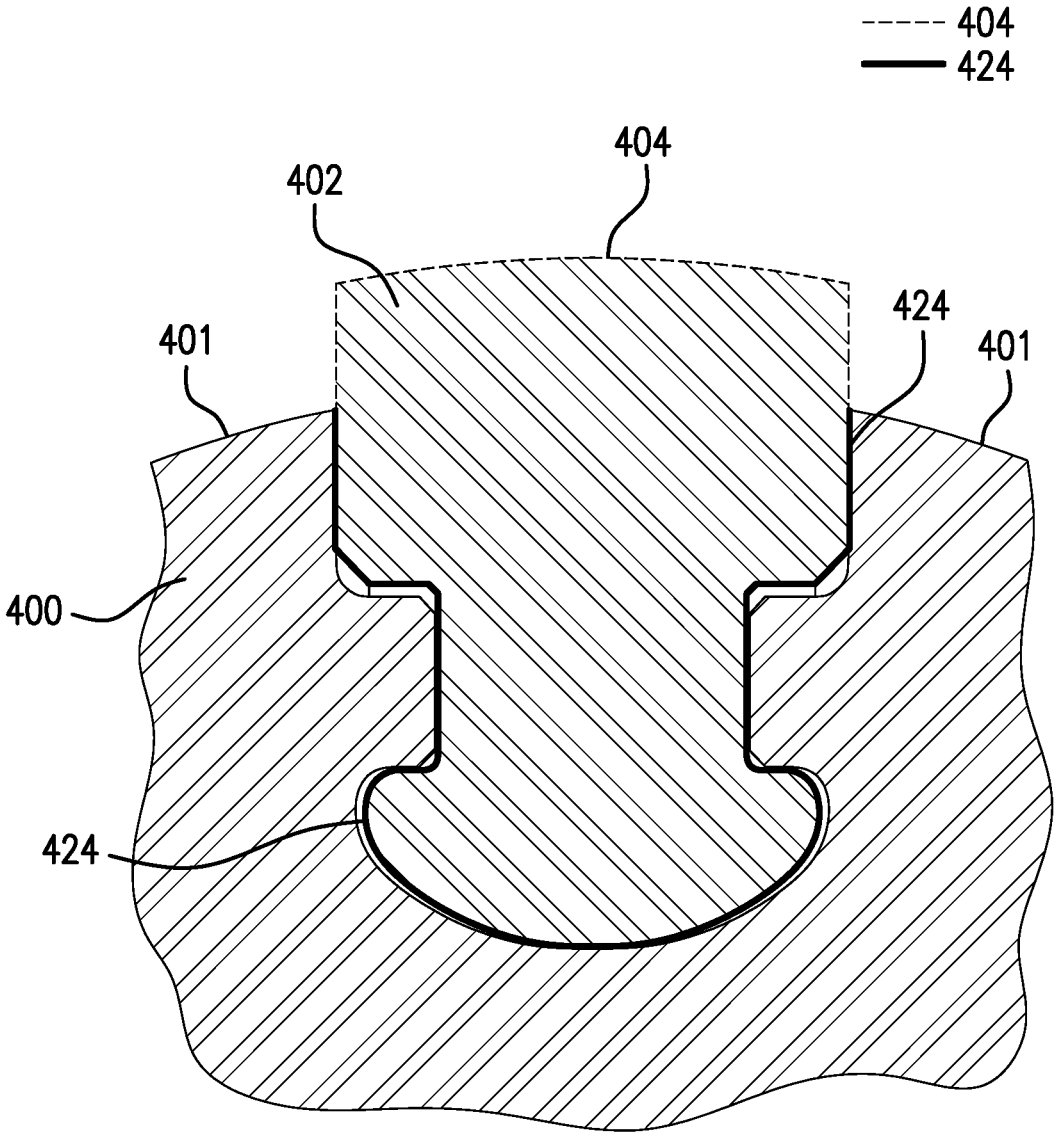
FIG. 4 is a schematic illustration of an extendable element in accordance with the present disclosure illustration contact and engagement surfaces.

Turning to FIG. 4, an example illustration of the contact surfaces and engagement surfaces as used and employed by embodiments of the present disclosure is shown. As shown, an extendable element 402 defines a contact surface 404 as any surface of the extendable element 402 that is exposed above a surface 401 of a tool body 400. The extendable element 402 further defines an engagement surface 424 that engages with an interior contour of the tool body 400 (e.g., an extendable element track) or a cartridge, a frame, or a cassette that is connected to the respective tool body 400.

Referring now to FIG. 3B, one embodiment of an asymmetric extendable element and extendable element track shape that features a stress-optimized bottom and side wall curvilinear contour consisting of a geometry that couples several radii or straight lines in a way that the resulting stress from outer load conditions is minimized within the tool body or cassette is illustrated in FIG. 3B. Those of skill in the art will appreciate that, as shown in FIG. 3B, the transition from the first portion 312*b* to the second portion 314*b* is asymmetric and includes a curvilinear contour or curved shape or geometry.

In the embodiment of FIG. 3B, a tangential to a tool axis implemented load is led through the extendable element 302*b* coming from an angled contact area 317*b* (of the contact surface 304*b*) and is carried by the stress-optimized opposite side of the extendable element track 303*b*. The geometry of the extendable element 302*b* and the extendable element track 303*b*, and the application of a tangential force, results in a one-side engagement (e.g., engagement surfaces 324*b*, 326*b*) between the extendable element 302*b* and the extendable element track 303*b* of the tool body 300*b*. Such design is optimized in regards to transmitting torque in one predefined direction, as will be appreciated by those of skill in the art. Such torque extendable elements can be employed in various downhole tools and/or downhole components such as bottomhole assemblies, anchor tools, anchors, liner running tools, hangers, extendable stabilizers, reamers, steering tools, measuring tools (e.g., calipers), expander tools (e.g., tools for expanding liner tubes), centralizer or other tools configured to position downhole components within a borehole by means of extendable elements, etc. In general, such weight and/or torque transmitting extendable elements can be optimized for all down hole applications that require and/or demand transmitting weight and/or torque from an inner device to an outer device or vice versa.

Referring now to FIG. 3A, a symmetric shape or geometry is shown. The curvilinear contour of the first portion 312*a* of the extendable element 302*a* (and the respective receiving portion 318*a* of the extendable element track 303*a* of the tool body 300*a*) allows transmitting relatively high loads such as loads that can be transmitted with conventional rectangular shaped extendable elements through the tool body 300*a*.

Accordingly, advantageously, extendable elements and extendable element tracks provided herein in accordance with embodiments of the present disclosure provide a curvilinear contoured first portion that is configured to engage within a similarly configured and curvilinear contoured extendable element track receiving portion. Such curvilinear contoured or curved configurations enable improved stress profiles within the tool bodies and within the system as a whole.

The above described extendable element track configurations (e.g., shapes, contours, etc.) can be manufactured directly into the respective tool body or in a cartridge, a cassette, or a frame that can be mounted into the tool body. That is, in some embodiments, extendable elements as provided herein can be installed into one or more cartridges, cassettes, or frames that include extendable element tracks as shown and described, and the cassettes can then be installed into a tool body. Further, in some embodiments, the tool body can be configured with a single track and thus receive a single extendable element. Alternatively, tool bodies (or cartridges, cassettes, frames, etc.) in accordance with the present disclosure can include multiple extendable element tracks and a respective number of extendable elements. In configurations that include multiple extendable element tracks and extendable elements, the extendable element tracks can be equally spaced or not in a circumferential or axial order or configuration. The cross section of the extendable element tracks, as provided herein, can be implemented in a straight line, a radius curve, a multi-center curve, or as a user-defined track. Furthermore, extendable element tracks in accordance with the present disclosure can proceed in a user-defined direction with respect to a tool body axis. Further, advantageously, embodiments provided herein can be employed in downhole tools and/or downhole components such as bottomhole assemblies, anchor tools, anchors, liner running tools, hangers, extendable stabilizers, reamers, steering tools, measuring tools (e.g., calipers), expander tools (e.g., tools for expanding liner tubes), centralizers or other tools configured to position a downhole component within a borehole by means of extendable elements, etc.

In addition to the improved extendable elements and extendable element tracks shown and described in FIGS. 3A-3B, embodiments provided herein are directed to stop blocks that are configured with the extendable elements. Stop blocks (e.g., stop blocks 206, 208) of the present disclosure are optionally implemented to stop the movement of a moving extendable element (e.g., extendable elements 202*a*, 202*b*, 302*a*, 302*b*). The stop blocks carry the axial implemented load from the moving part (e.g., the respective extendable element). The implementation of such an extendable element-stop block relationship allows protection of the tool body from wear, enables choice of material independent from the tool body, and/or can ease adjustment work for different applications.

Figure 5A:
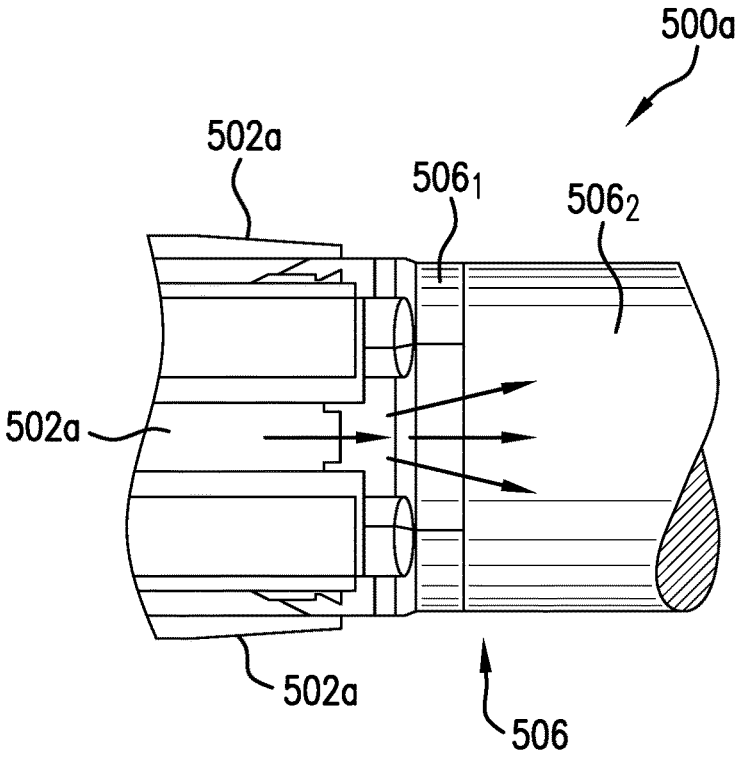
FIG. 5A is a schematic illustration of an extendable element and stop block configuration in accordance with an embodiment of the present disclosure.

FIG. 5A illustrates a first example embodiment of a stop block configuration in accordance with the present disclosure. FIG. 5A illustrates a portion of a tool body 500*a* similar to that shown in FIG. 2A, and includes multiple extendable elements 502*a* configured within extendable element tracks (such as described above) and a stop block 506. The stop block 506 is configured as a sleeve, screw-on nut, or other body that is attached to or connected to the tool body 500*a*. In some embodiments, the stop block 506 includes a threaded interior surface that engages with a threaded surface of the tool body 500*a*. In other embodiments, the stop block 506 can be fastened to the tool body 500*a* by fasteners, clamps, or other mechanisms.

In the embodiment of FIG. 5A, a power path through an extendable element 502*a* and into the stop block 506 is indicated by the arrows. In such a configuration as shown in FIG. 5A, the applied load of the extendable elements 502*a* is received by the stop block 506 in the form of a sleeve. As noted, the sleeve can be screwed or clamped onto the tool body 500*a*. By employing a sleeve-style stop block 506, the amount of surface area is increased and the load situation of the involved parts can be smoothed. Such configuration also enables easy adjustment by the use of adjustment shims or by different thread engagement positions of the stop block 506. In addition the sleeve design of the stop block 506 enables the sealing of high loaded areas. Such sealing can prevent the high loaded areas from corrosive effects.

Figure 5B:
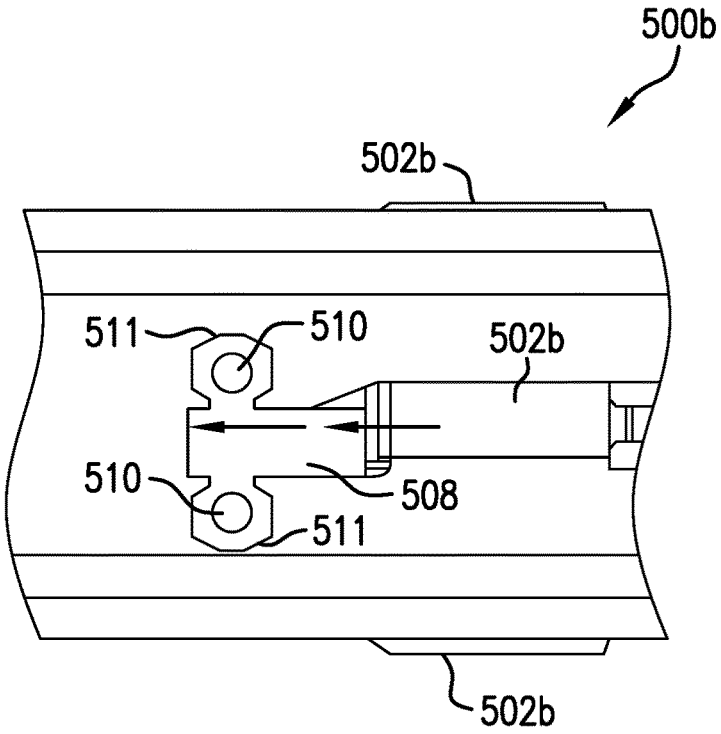
FIG. 5B is a schematic illustration of an extendable element and stop block configuration in accordance with another embodiment of the present disclosure.

Turning to FIG. 5B, each respective extendable element 502*b* is configured with a single stop block 508. Similar to FIG. 5A, a power path through an extendable element 502*b* and into a respective stop block 508 is indicated by the arrows. In this configuration, the stop block 508 is fixed in position by one or more fasteners 510 fixed into securing members 511 of the stop block 508. The fasteners 510 (e.g., mounting screws) are not in the power train of the part (e.g., along the power path) but rather are fixed within the securing members 511 of the stop block 508. The securing members 511 of the stop block 508, and thus the fasteners 510, are positioned to the side of the power path (e.g., as indicated by the arrows in FIG. 5B). Accordingly, the securing members 511 and the fasteners 510 are thus decoupled by a shaped contour that allows separation of the power train from the preload forces of the fasteners 510. Advantageously, the changing load and deformation conditions will not influence the mounting situation of the fasteners 510. In some embodiments, the stop blocks 508 can also fulfill a length adjustment to properly adjust the simultaneous contact points of multiple extendable elements 502*b*.

As illustrated in FIG. 5A, the stop block 506 is formed of multiple components or pieces (e.g., a splitted-sleeve having a first portion 5061 and a second portion 5062). In contrast, the stop block 508 of FIG. 5B is illustrated as a unitary body (retained by fasteners 510). However, those of skill in the art will appreciate that alternative configurations are possible without departing from the scope of the present disclosure. For example, the sleeve-type stop block of FIG. 5A can be a single sleeve and/or component and/or the stop blocks of FIG. 5B can be formed from multiple components.

Figure 6A:
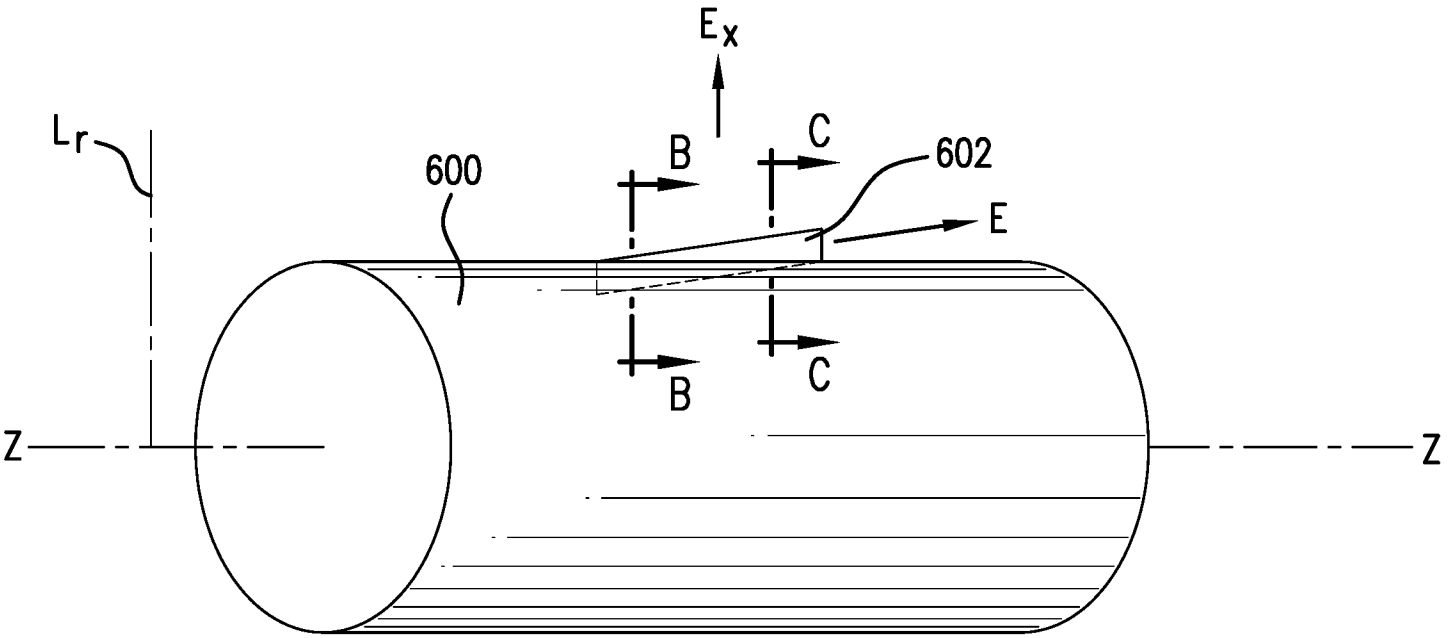
FIG. 6A is a schematic illustration of a tool body of a downhole tool having an extendable element engaged therewith in accordance with an embodiment of the present disclosure.
Figure 6B:
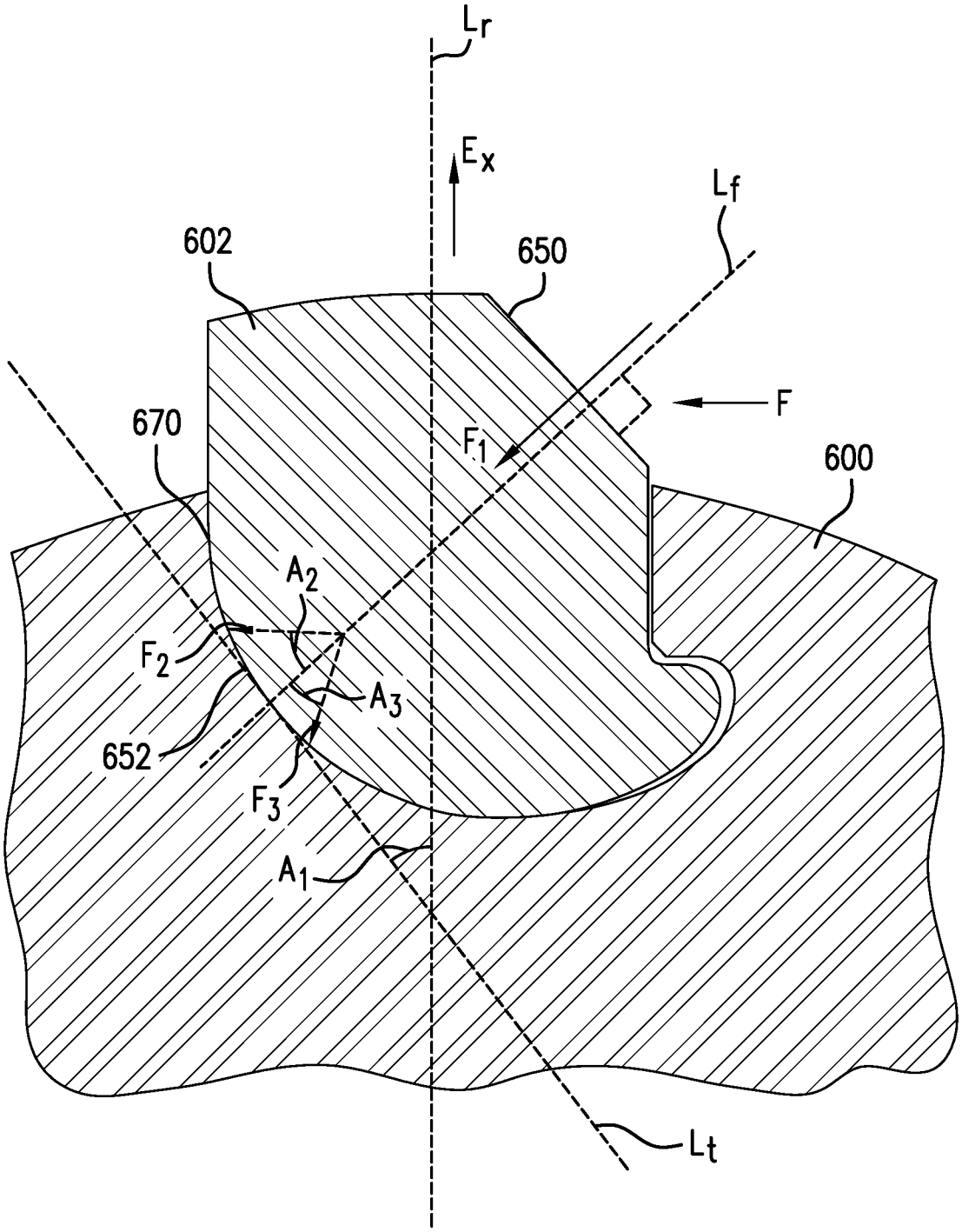
FIG. 6B is a cross-sectional illustration of the extendable element of FIG. 6A as viewed along the line B-B.
Figure 6C:
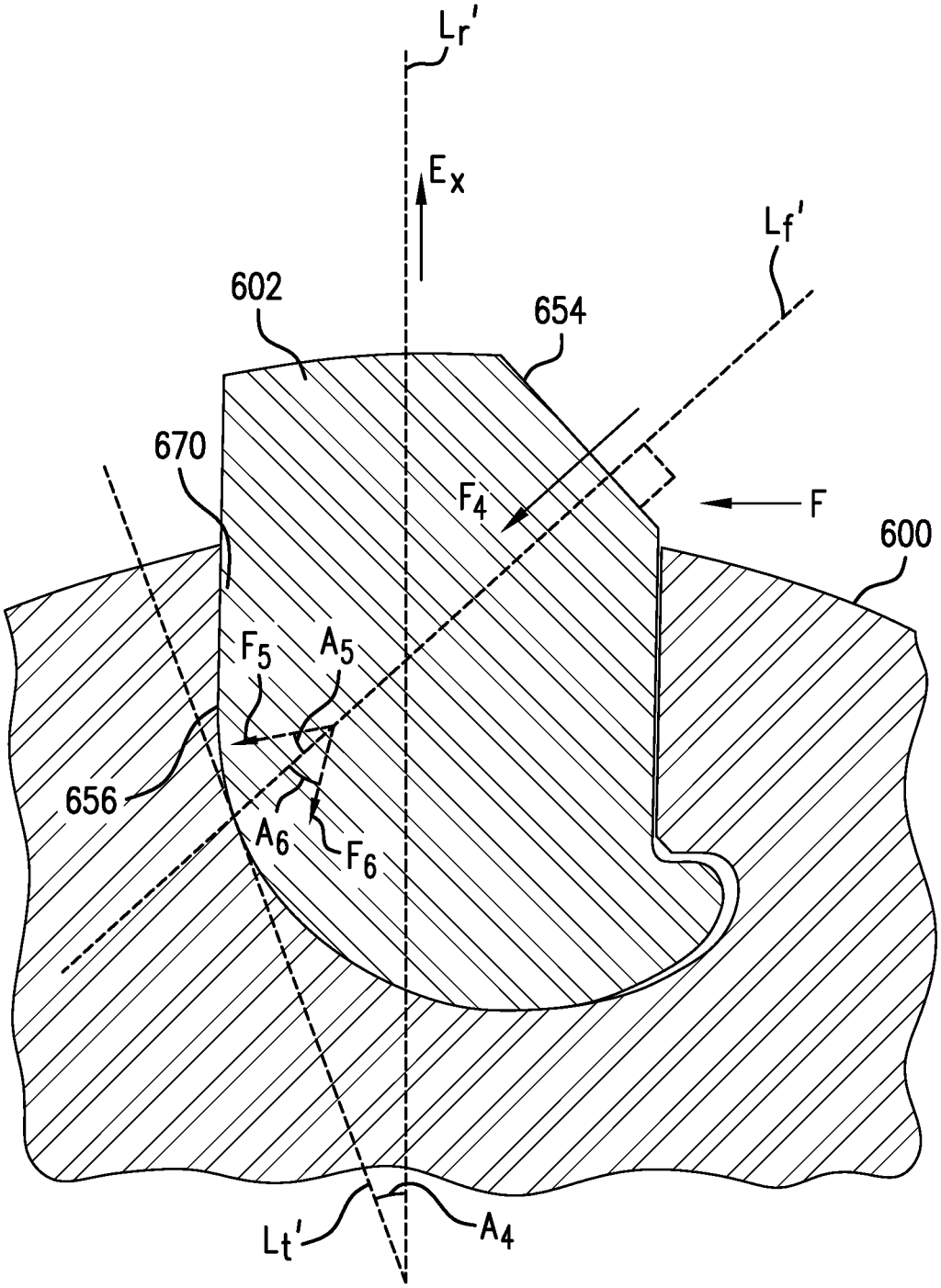
FIG. 6C is a cross-sectional illustration of the extendable element of FIG. 6A as viewed along the line C-C.

Turning now to FIGS. 6A-6C, an example of an extendable element and extendable element track in accordance with a non-limiting embodiment of the present disclosure is shown. FIG. 6A is a schematic illustration of a downhole tool 600 having an extendable element 602 installed therein and configured to be extendable from the downhole tool 600 in an extension direction E. The extension direction E includes an extension direction component $E_x$ that is perpendicular/radial relative to a tool axis Z. In some non-limiting embodiments, the extension direction component $E_x$ may be equal to the extension direction E (i.e., the extendable element move radially outward from a tool body). However, in other embodiments, the extension direction E may have a component that is parallel to the tool axis Z, and thus the extension direction component $E_x$ may be only a radial component (i.e., a component) of the extension direction E. Accordingly, in some embodiments, the extendable element may move along a path that is included with respect to the tool axis Z. As explained above, the extendable element 602 in FIGS. 6A-6C may be incorporated in the tool body or in a cartridge, a frame, or a cassette that is connected to the respective tool body.

FIG. 6B is a cross-sectional illustration of the extendable element 602 in accordance with a non-limiting embodiment as viewed along the line B-B of FIG. 6A. FIG. 6C is a second cross-sectional illustration of the extendable element 602 in accordance with a non-limiting embodiment as viewed along the line C-C, at a different position, of FIG. 6A. The extendable element 602 of FIGS. 6A-6C can be installed in and operate with any type of downhole tool or other body that is disposed downhole and can act as an anchor or other device or structure, as known in the art. For example, the extendable element 602 can be installed in downhole tools and/or downhole components such as bottomhole assemblies, anchor tools, anchors, liner running tools, hangers, extendable stabilizers, reamers, steering tools, measuring tools (e.g., calipers), expander tools (e.g., tools for expanding liner tubes), centralizers or other tools configured to position a downhole component within a borehole by means of extendable elements, etc.

As shown in FIGS. 6A-6C, the extendable element 602 of the downhole tool 600 has an extension direction component $E_x$ perpendicular to the tool axis Z of downhole tool 600 (e.g., tool axis Z is into and out of the page of FIGS. 6B-6C). That is, when extending from the downhole tool 600, the extendable element 602 will move parallel to the tool axis Z and in the extension direction component $E_x$ perpendicular to the tool axis Z on the cross-sections of FIGS. 6B-6C. The extension direction component $E_x$ may be parallel to, or along, a radial line Lr of the downhole tool 600.

A force F may be applied to the extendable element 602 when in operation, such as when the downhole tool 600 is in operation, and it is desired to have the extendable element 602 extend from the downhole tool 600. The force may be caused by various effects such as, but not limited to, contact with a borehole wall or downhole equipment (e.g., casings, liners, hangers, etc.), pressure differences or flow of fluid (e.g., mud) that may be in contact with the extendable element 602, or a combination thereof. Therefore, the force F may have any direction relative to the extendable element 602 depending on the effects that cause the force F. As an example, FIGS. 6B-6C show the force F in a direction that is approximately circumferential to the downhole tool 600. However, those skilled in the art will appreciated that this is not to be construed as a limitation and that the force F can have any direction relative to the extendable element 602. The downhole tool 600 can be a downhole tool and/or downhole component such as bottomhole assemblies, anchor tools, anchors, liner running tools, hangers, extendable stabilizers, reamers, steering tools, measuring tools (e.g., calipers), expander tools (e.g., tools for expanding liner tubes), centralizers or other tools configured to position a downhole component within a borehole by means of extendable elements, etc.

The cross-section shown in FIG. 6B can define a first cross-section of the extendable element 602 that includes the extension direction component $E_x$ that is perpendicular to the axis of the downhole tool 600. The cross-section shown in FIG. 6C can define a second cross-section of the extendable element 602 that includes the extension direction component $E_x$ that is perpendicular to the axis of the downhole tool 600. As illustrated, the second cross-section (FIG. 6C) is at a different axial location of the extendable element 602 along the tool axis Z.

As shown in FIG. 6B, the extendable element 602 includes a first surface 650 configured to receive a first force component $F_1$ of the force F. The first force component $F_1$ is a component of the force F (e.g., greater or less than the total force F) that is substantially perpendicular to the first surface 650 at the first cross-section (FIG. 6B). That is, the first force component $F_1$ of the force F is in a direction along a force line $L_f$ in the first cross-section. The force line $L_f$ is a line defined as perpendicular to the first surface 650 and in the plane of the first cross-section. The extendable element 602 further includes a second surface 652. The second surface 652 of the extendable element 602 is configured to transfer at least a part of the force F to the body of the downhole tool 600. That is, in the embodiment of FIGS. 6A-6C, the second surface 652 can contact a portion of the downhole tool 600, such as in a track configured to receive the extendable element 602. The first surface 650 and the second surface 652 are portions of surfaces of the extendable element 602 at or in the first cross-section.

The second surface 652, as shown, is curved and can define a first tangent line $L_t$ at the location where the force line $L_f$ intersects the second surface 652. That is, in some embodiments, the second surface 652 is curvilinear. In other embodiments, the second surface 652 and the tangent line $L_t$ is parallel to a linear portion of the second surface 652. In the embodiment of FIG. 6B, the first surface 650 and at least a portion of the second surface 652 may be designed in a way so that a first angle $A_1$ is defined at the intersection of the tangent line $L_t$ and the extension direction component $E_x$, the first angle $A_1$ is an angle between 0° and 90°.

As shown in FIG. 6B, the first force component $F_1$ of force F comprises a first force subcomponent $F_2$ and a second force subcomponent $F_3$, the first and second force subcomponents $F_2$, $F_3$ sum up to the first force component $F_1$. The first and second force subcomponents $F_2$, $F_3$ are axis symmetric to the first force component $F_1$. A direction of the first force subcomponent $F_2$ intersects the second surface 652 at a second angle $A_2$. Similarly, the second force subcomponent $F_3$ and the second surface 652 form a third angle $A_3$. In some non-limiting embodiments, the second and third angles $A_2$, $A_3$ are substantially equal to allow a symmetric transfer of forces from the extendable element 602 to the downhole tool 600 which is beneficial for the mechanical stability of the whole system.

As shown in FIG. 6C, the second cross-section of the extendable element 602 can define a shape, geometry, and size that is similar or the same as the first cross-section FIG. 6B (e.g., the extendable element 602 is uniform in the direction of the tool axis Z). However, those of skill in the art will appreciate that the extendable elements of the present disclosure can have varying or variable cross-sections in the direction of the tool axis Z. In the present non-limiting example embodiment, the second cross-section includes the extension direction component $E_x$ perpendicular to the tool axis Z. A third surface 654 is configured to receive a second force component $F_4$ of the force F. Similar to that described above, the second force component $F_4$ is substantially perpendicular to the third surface 654. A fourth surface 656 is configured to transfer at least a part of the second force component $F_4$ to the body of the downhole tool 600. Similar to that described above with respect to the second surface 652, a second tangent line $L_t'$ of the fourth surface 656 at the location where the force line $L_f'$ intersects the second surface 656 and the extension direction component $E_x$ form a fourth angle $A_4$ that is between 0° and 90°.

That is, as shown in FIG. 6C, in the second cross-section, the extendable element 602 includes a third surface 654 configured to receive a second force component $F_4$ of the force F. The second force component $F_4$ is a component of the force F that is substantially perpendicular to the third surface 654 at the second cross-section (FIG. 6C). That is, the second force component $F_4$ is a component of the force F that is in a direction along a force line $L_f'$ in the second cross-section. The force line $L_f'$ is a line defined as perpendicular to the third surface 654 and in the plane of the second cross-section. The extendable element 602 further includes a fourth surface 656. The fourth surface 656 of the extendable element 602 is configured to transfer at least a part of the force F to the body of the downhole tool 600. As explained above, the extendable element 602 in FIGS. 6A-6C may be incorporated in the tool body or in a cartridge, a frame, or a cassette that is connected to the respective tool body. That is, in the embodiment of FIGS. 6A-6C, the fourth surface 656 can contact a portion of the downhole tool 600, such as in a track configured to receive the extendable element 602. The third surface 654 and the fourth surface 656 are portions of surfaces of the extendable element 602 at or in the second cross-section.

The fourth surface 656, as shown, is curved and can define a second tangent line $L_t'$ at the location where the force line $L_f'$ intersects the second surface 656. In some embodiments, the fourth surface 656 is curvilinear. In other embodiments, the second surface 652 and the tangent line $L_t$ is parallel to a linear portion of the second surface 652. In the embodiment of FIG. 6C, the third surface 654 and at least a portion of the fourth surface 656 may be designed in a way so that a fourth angle $A_4$ is defined at the intersection of the second tangent line $L_t'$ and the extension direction component $E_x$, the fourth angle $A_4$ is an angle between 0° and 90°.

As shown in FIG. 6C, the second force component $F_4$ of force F comprises a third force subcomponent $F_5$ and a fourth force subcomponent $F_6$, the third and fourth force subcomponents $F_5$, $F_6$ sum up to the second force component $F_4$. The third and fourth force subcomponents $F_5$, $F_6$ of the second force component $F_4$ are axis symmetric to the second force component $F_4$. A direction of the first force subcomponent $F_5$ intersects the third surface 656 at a fifth angle $A_5$. Similarly, the second force subcomponent $F_6$ and the second tangent line $L_t'$ form a sixth angle $A_6$. In some non-limiting embodiments, the fifth and sixth angles $A_5$, $A_6$ are substantially equal.

As noted above, the embodiment of FIGS. 6A-6C is not to be limiting. For example, in some embodiments, the curved surface of extendable elements of the present disclosure can form an arc length of a circle or a multi-center curve. That is, one or both of the second surface 652 or the fourth surface 656 of FIGS. 6A-6C, can be an arc length of a circle or a multi-center curve. In other embodiments, one or more of the second and fourth surfaces 652, 656 of the extendable element 602 may be piecewise linear. Further, as will be appreciated by those of skill in the art, the first surface 650 and the third surface 654 may be portions of the same surface at different points or locations along the axial length of the extendable element 602.

As discussed above, force can be transferred into the downhole tool 600 through the extendable element 602. As shown in FIGS. 6B-6C, the force F is transferred to the downhole tool 600 via mating surfaces 670, 672. The mating surfaces 670, 672, as shown, are part of the downhole tool 600 and can define a receiving element (e.g., a track within the downhole tool 600). Thus, the receiving element of the embodiment of FIGS. 6A-6C is integrated with and/or integral with the downhole tool 600. However, those of skill in the art will appreciate that receiving elements and/or mating surfaces can have different configurations, depending, in part, on the downhole tool. For example, in some non-limiting embodiments, the receiving element can be a cartridge, cassette, frame, etc. that receives the extendable element and can be inserted into and/or affixed to a downhole tool.

Embodiment 1

An extendable element of a downhole tool having an extension direction component perpendicular to a tool axis, wherein a force is applied to the extendable element when in operation, the extendable element comprising a first cross-section that includes the extension direction component: a first surface configured to receive a first force component of the force, the first force component substantially perpendicular to the first surface; and a second surface configured to transfer at least a portion of the first force component of the force to a body of the downhole tool, wherein the second surface and the extension direction component perpendicular to the tool axis draw a first angle that is between 0° and 90°.

Embodiment 2

The extendable element of any of the preceding embodiments, wherein the second surface is curvilinear.

Embodiment 3

The extendable element of any of the preceding embodiments, wherein the second surface comprises an arc length of a circle or a multi-center curve.

Embodiment 4

The extendable element of any of the preceding embodiments, further comprising a receiving unit configured to receive the second surface such that the force is transferred to the tool body via a mating surface of the receiving element.

Embodiment 5

The extendable element of any of the preceding embodiments, wherein: the first force component includes a first force subcomponent and a second force subcomponent, the first and second force subcomponents of the first force component sum up to the first force component, the first and second force subcomponents are axis symmetric to the first force component, and the first force subcomponent and the second surface draw a second angle, the second force subcomponent and the second surface draw a third angle, wherein the second and third angles are substantially equal.

Embodiment 6

The extendable element of any of the preceding embodiments, wherein the second surface is curvilinear.

Embodiment 7

The extendable element of any of the preceding embodiments, wherein, in a second cross-section that includes the extension direction component perpendicular to the tool axis at a different axial location in a tool axis direction from the first cross-section, the extendable element further comprises: a third surface configured to receive a second force component of the force, the second force component substantially perpendicular to the third surface; and a fourth surface configured to transfer at least a part of the second force component force to the body of the downhole tool, wherein the fourth surface and the extension direction component draw a fourth angle that is between 0° and 90°.

Embodiment 8

The extendable element of any of the preceding embodiments, wherein the third surface is curvilinear.

Embodiment 9

The extendable element of any of the preceding embodiments, wherein the third surface comprises an arc length of a circle or a multi-center curve.

Embodiment 10

The extendable element of any of the preceding embodiments, further comprising a receiving unit configured to receive the second surface such that the force is transferred to the tool body via a mating surface of the receiving element.

Embodiment 11

The extendable element of any of the preceding embodiments, wherein the receiving element is one of a cassette, a frame, or a cartridge.

Embodiment 12

A downhole tool comprising: a tool body defining a tool axis; and an extendable element engageable with the tool body, the extendable element having an extension direction component perpendicular to the tool axis, wherein a force is applied to the extendable element when in operation, the extendable element comprising a first cross-section that includes the extension direction component: a first surface configured to receive a first force component of the force, the first force component substantially perpendicular to the first surface; and a second surface configured to transfer at least a portion of the first force component of the force to the tool body, wherein the second surface and the extension direction component perpendicular to the tool axis draw a first angle that is between 0° and 90°.

Embodiment 13

The downhole of any of the preceding embodiments, further comprising a receiving element, wherein the force is transferred to the tool body via a mating surface of the receiving element.

Embodiment 14

The downhole of any of the preceding embodiments, wherein the receiving element is one of a cassette, a frame, or a cartridge.

Embodiment 15

The downhole of any of the preceding embodiments, wherein the second surface is curvilinear.

Embodiment 16

The downhole of any of the preceding embodiments, wherein the second surface comprises an arc length of a circle or a multi-center curve.

Embodiment 17

The downhole of any of the preceding embodiments, wherein: the first force component includes a first force subcomponent and a second force subcomponent, the first and second force subcomponents of the first force component sum up to the first force component, the first and second force subcomponents are axis symmetric to the first force component, and the first force subcomponent and the second surface draw a second angle, the second force subcomponent and the second surface draw a third angle, wherein the second and third angles are substantially equal.

Embodiment 18

The downhole of any of the preceding embodiments, wherein the second surface is curvilinear.

Embodiment 19

The downhole of any of the preceding embodiments, wherein, in a second cross-section that includes the extension direction component perpendicular to the tool axis at a different axial location in a tool axis direction from the first cross-section, the extendable element further comprises: a third surface configured to receive a second force component of the force, the second force component substantially perpendicular to the third surface; and a fourth surface configured to transfer at least a part of the second force component force to the body of the downhole tool, wherein the fourth surface and the extension direction component draw a fourth angle that is between 0° and 90°.

Embodiment 20

The downhole of any of the preceding embodiments, wherein the third surface is curvilinear.

Embodiment 21

The downhole of any of the preceding embodiments, wherein the third surface comprises an arc length of a circle or a multi-center curve.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. An extendable element of a downhole tool within a borehole, the downhole tool connected to a drill pipe and a disintegrating tool, wherein the disintegrating tool is rotated by rotating the drill pipe, the extendable element in contact with at least one of a borehole wall, a casing in the borehole, a liner in the borehole, and a hanger in the borehole, the downhole tool extendable by the extendable element in an extension direction having a component perpendicular to an axis of the downhole tool, wherein a force is applied to the extendable element when in operation, the extendable element comprising a first cross-section that includes the extension direction component that is perpendicular to the axis of the downhole tool, the first cross-section comprising:

a first surface of the extendable element configured to receive a first force component of the force, the first force component substantially perpendicular to the first surface of the extendable element; and a second surface of the extendable element configured to transfer at least a portion of the first force component of the force to a body of the downhole tool, wherein the second surface and the extension direction component perpendicular to the axis of the downhole tool draw a first angle that is between 0° and 90°.

2. The extendable element of claim 1, wherein the second surface of the extendable element is curvilinear.

3. The extendable element of claim 2, wherein the second surface of the extendable element comprises an arc length of a circle or a multi-center curve.

4. The extendable element of claim 2, further comprising a receiving element configured to receive the second surface of the extendable element such that the force is transferred to the body of the downhole tool via a mating surface of the receiving element.

5. The extendable element of claim 1, wherein:

the first force component includes a first force subcomponent and a second force subcomponent, the first and second force subcomponents of the first force component sum up to the first force component, the first and second force subcomponents are axis-symmetric to the first force component, and the first force subcomponent and the second surface of the extendable element draw a second angle, the second force subcomponent and the second surface of the extendable element draw a third angle, wherein the second and third angles are substantially equal.

6. The extendable element of claim 5, wherein the second surface of the extendable element is curvilinear.

7. The extendable element of claim 1, wherein, in a second cross-section that includes the extension direction component perpendicular to the axis of the downhole tool at a different axial location in a direction of the axis of the tool from the first cross-section, the extendable element further comprises:

a third surface of the extendable element configured to receive a second force component of the force, the second force component substantially perpendicular to the third surface of the extendable element; and a fourth surface of the extendable element configured to transfer at least a part of the second force component force to the body of the downhole tool, wherein the fourth surface of the extendable element and the extension direction component draw a fourth angle that is between 0° and 90°.

8. The extendable element of claim 7, wherein the fourth surface of the extendable element is curvilinear.

9. The extendable element of claim 8, wherein the fourth surface of the extendable element comprises an arc length of a circle or a multi-center curve.

10. The extendable element of claim 1, further comprising a receiving element configured to receive the second surface of the extendable element such that the force is transferred to the body of the downhole tool via a mating surface of the receiving element.

11. The extendable element of claim 10, wherein the receiving element is one of a cassette, a frame, or a cartridge.

12. The extendable element of claim 1, wherein the downhole tool further comprises:

an additional extendable element of the downhole tool within the borehole and in contact with at least one of the borehole wall, the casing in the borehole, the liner in the borehole, and the hanger in the borehole, the downhole tool extendable by the additional extendable element in a different extension direction having a component perpendicular to the axis of the downhole tool, wherein an additional force is applied to the additional extendable element when in operation, the additional extendable element comprising a respective first cross-section that includes the different extension direction component that is perpendicular to the axis of the downhole tool, the respective first cross-section of the additional extendable element comprising:

a respective first surface of the additional extendable element configured to receive a first force component of the additional force, the first force component of the additional force substantially perpendicular to the respective first surface of the additional extendable element; and a respective second surface of the additional extendable element configured to transfer at least a portion of the first force component of the additional force to the body of the downhole tool, wherein the respective second surface of the additional extendable element and the different extension direction component perpendicular to the axis of the downhole tool draw a different first angle that is between 0° and 90°.

13. A downhole system for operation within a borehole comprising:

a drill pipe;

a disintegrating tool operably connected to the drill pipe, wherein the disintegrating tool is rotated by rotating the drill pipe;

a downhole tool having a body by defining an axis of the downhole tool, the downhole tool connected to the drill pipe and the disintegrating tool; and an extendable element in contact with at least one of a borehole wall, a casing in the borehole, a liner in the borehole, and a hanger in the borehole, the extendable element engageable with the body of the downhole tool, the downhole tool extendable by the extendable element in an extension direction having a component perpendicular to the axis of the downhole tool, wherein a force is applied to the extendable element when in operation, the extendable element comprising a first cross-section that includes the extension direction component that is perpendicular to the axis of the downhole tool, the first cross-section comprising:

a first surface of the extendable element configured to receive a first force component of the force, the first force component substantially perpendicular to the first surface of the extendable element; and a second surface of the extendable element configured to transfer at least a portion of the first force component of the force to the body of the downhole tool, wherein the second surface of the extendable element and the extension direction component perpendicular to the axis of the downhole tool draw a first angle that is between 0° and 90°.

14. The downhole system of claim 13, further comprising a receiving element, wherein the force is transferred to the body the downhole tool via a mating surface of the receiving element.

15. The downhole system of claim 14, wherein the receiving element is one of a cassette, a frame, or a cartridge.

16. The downhole system of claim 13, wherein the second surface of the extendable element is curvilinear.

17. The downhole system claim 16, wherein the second surface of the extendable element comprises an arc length of a circle or a multi-center curve.

18. The downhole system of claim 13, wherein:

the first force component includes a first force subcomponent and a second force subcomponent, the first and second force subcomponents of the first force component sum up to the first force component, the first and second force subcomponents are axis-symmetric to the first force component, and the first force subcomponent and the second surface of the extendable element draw a second angle, the second force subcomponent and the second surface of the extendable element draw a third angle, wherein the second and third angles are substantially equal.

19. The downhole system of claim 18, wherein the second surface of the extendable element is curvilinear.

20. The downhole system of claim 13, wherein, in a second cross-section of the extendable element that includes the extension direction component that is perpendicular to the axis of the downhole tool at a different axial location in a direction of the axis of the downhole tool from the first cross-section, the extendable element further comprises:

a third surface of the extendable element configured to receive a second force component of the force, the second force component substantially perpendicular to the third surface of the extendable element; and a fourth surface of the extendable element configured to transfer at least a part of the second force component force to the body of the downhole tool, wherein the fourth surface of the extendable element and the extension direction component draw a fourth angle that is between 0° and 90°.

21. The downhole system of claim 20, wherein the fourth surface of the extendable element is curvilinear.

22. The downhole system of claim 21, wherein the fourth surface of the extendable element comprises an arc length of a circle or a multi-center curve.

23. The downhole system of claim 13, wherein the downhole tool further comprises:

an additional extendable element of the downhole tool within the borehole and in contact with at least one of the borehole wall, the casing in the borehole, the liner in the borehole, and the hanger in the borehole, the downhole tool extendable by the additional extendable element in a different extension direction having a component perpendicular to the axis of the downhole tool, wherein an additional force is applied to the additional extendable element when in operation, the additional extendable element comprising a respective first cross-section that includes the different extension direction component that is perpendicular to the axis of the downhole tool, the respective first cross-section of the additional extendable element comprising:

a respective first surface of the additional extendable element configured to receive a first force component of the additional force, the first force component of the additional force substantially perpendicular to the respective first surface of the additional extendable element; and a respective second surface of the additional extendable element configured to transfer at least a portion of the first force component of the additional force to the body of the downhole tool, wherein the second surface of the additional extendable element and the different extension direction component perpendicular to the axis ofthe downhole tool draw a first angle that is between 0° and 90°.

* * * * *